US008842501B2

(12) United States Patent
Ziemba et al.

(10) Patent No.: US 8,842,501 B2
(45) Date of Patent: Sep. 23, 2014

(54) SYSTEMS AND METHODS FOR TIMING DOSAGE PERIODS

(75) Inventors: Robert J. Ziemba, Cincinnati, OH (US); Vernon D. Ortenzi, Burlington, KY (US)

(73) Assignee: Mallinckrodt LLC, Hazelwood, MO (US)

( * ) Notice: Subject to any disclaimer, the term of this patent is extended or adjusted under 35 U.S.C. 154(b) by 0 days.

(21) Appl. No.: 13/015,223

(22) Filed: Jan. 27, 2011

(65) Prior Publication Data

US 2011/0216627 A1 Sep. 8, 2011

Related U.S. Application Data

(60) Provisional application No. 61/300,377, filed on Feb. 1, 2010.

(51) Int. Cl.

| | |
|---|---|
| ***G04F 8/00*** | (2006.01) |
| ***G04F 10/00*** | (2006.01) |
| ***G04B 47/00*** | (2006.01) |
| ***B65D 77/00*** | (2006.01) |

(52) U.S. Cl.

CPC ..... *B65D 77/00* (2013.01); *G04B 47/00* (2013.01)

USPC ..... 368/109; 368/250

(58) Field of Classification Search

USPC ..... 368/108–109, 10–12, 224, 250–251, 368/256

See application file for complete search history.

(56) References Cited

U.S. PATENT DOCUMENTS

| | | | | |
|---|---|---|---|---|
| 4,367,955 | A | 1/1983 | Ballew | |
| 4,419,016 | A * | 12/1983 | Zoltan | 368/10 |
| 5,233,571 | A * | 8/1993 | Wirtschafter | 368/10 |
| 6,198,383 | B1 * | 3/2001 | Sekura et al. | 340/309.4 |
| 6,633,796 | B1 * | 10/2003 | Pool et al. | 700/231 |
| 6,667,936 | B1 * | 12/2003 | Ditzig | 368/10 |
| 6,707,763 | B2 | 3/2004 | Osberg et al. | |
| 6,845,064 | B2 * | 1/2005 | Hildebrandt | 368/10 |
| 7,081,807 | B2 * | 7/2006 | Lai | 340/309.7 |
| 7,236,428 | B1 * | 6/2007 | Morse | 368/10 |
| 7,382,692 | B1 * | 6/2008 | Hildebrandt | 368/10 |
| 7,408,843 | B2 | 8/2008 | Brandon | |
| 7,515,507 | B2 * | 4/2009 | Nanda | 368/10 |
| 7,532,544 | B2 * | 5/2009 | Morse | 368/19 |

* cited by examiner

*Primary Examiner* — Sean Kayes

(74) *Attorney, Agent, or Firm* — James L. Johnson; Marsh Fischmann & Breyfogle LLP

(57) ABSTRACT

Systems and methods for tracking dosage periods are disclosed. The systems and methods may include setting a timer (140) to a predetermined value corresponding to a dosage period in response to the engagement of a cover (110) to a container (120). An indication may be provided that corresponds to a remaining period in the dosage period set by the engagement of the cover (110) and container (120). The indication may also indicate a remaining time period in the dosage period.

24 Claims, 7 Drawing Sheets

SYSTEMS AND METHODS FOR TIMING DOSAGE PERIODS

CROSS REFERENCE TO RELATED APPLICATIONS

This patent application is a non-provisional application of, and claims priority to, co-pending U.S. Provisional Patent Application Ser. No. 61/300,377, filed Feb. 1, 2010, entitled "SYSTEMS AND METHOD FOR TIMING DOSAGE PERIODS," and the entire disclosure of which is hereby incorporated by reference in its entirety herein.

FIELD OF THE INVENTION

The present invention is generally related to the timing of dosage periods for a pharmaceutical product.

BACKGROUND

The safety and effectiveness of many pharmaceutical products are strongly affected by the dosing schedule for the pharmaceutical product. The prescribed time periods for taking a pharmaceutical product may affect the concentration of the pharmaceutical product and the amount of pharmaceutical product in the patient. Too much or too little of a pharmaceutical product can lead to adverse events or ineffective treatment. It is not uncommon for those taking medication to forget whether they have taken their medicine according to the appropriate dosing regimen or recommended use. This may be the result of a break in routine, taking multiple medications, mental disease states, or simply forgetting. When this occurs, there are several unsafe scenarios that may happen. If the patient has taken their dose, forgets that they have done so, and proceeds to take a second dose, the effect may be a doubling of the prescribed dosage. This could lead to an unsafe adverse event, In another scenario, the patient may have unintentionally skipped a dose and may later not remember if the dose had been taken. The patient may decide not to dose again in order to avoid the adverse effects of doubling a dose as discussed above. However, this may result in loss of effectiveness of the pharmaceutical product (e.g., in the case on an analgesic, the patient's pain resulting from a skipped dose may lead to the patient's pain reaching a level that becomes difficult to manage).

SUMMARY

The present invention may be characterized as relating to systems and methods for timing dosage periods for a pharmaceutical product. The present invention may also be characterized as relating to systems and methods for indicating a remaining time period in a dosage period in order to assist in maintaining a dosing regiment associated with a pharmaceutical product. In any case, the present invention may utilize a timer and an indicator. The timer may be set to an initial timer value corresponding to a dosage time period upon engagement of a cover with a container. The timer may be operative to count down a period corresponding to the dosage period and provide an indication of a remaining time period in the dosage period. This may assist in facilitating the determination of the appropriate time at which the pharmaceutical product should be administered.

There are several advantages to using a timer which is set to an initial timer value and counts down upon engagement of a cover with a container in lieu of a counter which resets to zero and begins counting up upon engagement of a cover to a container. For instance, a user need not remember the length of the dosing period associated with a pharmaceutical product because the engagement of a cover with the container (e.g, after dispensing a dose) may result in the resetting of the timer to the initial timer value associated with the dosing period corresponding to the pharmaceutical product. In turn, the user need only to take the pharmaceutical in the container upon the expiration of the timer. In contrast, a timer that resets to zero upon closure of the container and that begins to count up upon initiation of the timer may require the user to monitor the timer for the appropriate dosing period to be displayed. Accordingly, the user may be required to remember the dosing period associated with the pharmaceutical product. In the case of a user who, for instance, takes multiple medications, suffers from mental disease, or is simply forgetful, remembering the dosing period for a particular pharmaceutical product may be difficult. Additionally, a user that takes multiple medications having different dosing periods may be confused as a longer dosing period will necessarily include indications associated with earlier dosing periods (e.g., a twelve hour timer counting up to twelve hours will pass through a four hour mark, a six hour mark, etc., which may be associated with dosing periods for other medications taken by the user). However, a counter which counts down such that administration of the pharmaceutical product is associated with the expiration of a timer should help reduce the potential for incorrectly taking the pharmaceutical product. In this regard, a patient may be more prone to only take medication when the timer expires for any medication taken by the user.

Furthermore, a timer that counts up may not allow for construction of the timer using a simple, mechanical mechanism. In the case where the timer counts up, the mechanical device may be limited to a certain duration, thus not allowing the system to be used for longer durations. With a timer that counts down, the timer may be designed so as to operate mechanically for the desired dosing period.

Further still, in systems that count up, a displayed value differs for different dosing period durations as the end of the dosing time period approaches. For instance, when an hour is left in a four hour dosing period, an indication of three hours would show. However, when an hour is left in a six hour dosing period, an indication of five hours would show. This may be confusing for a user with, for instance, mental disabilities. In contrast, in a system which counts down, regardless of the dosing period, the ability to accurately determine the remaining period in a dosing period is the same. For instance, regardless of the original timer value for the dosing period, in a system that counts down, the display timer value should correspond to the remaining period (e.g., a value of one hour is presented when one hour of the dosing period remains, a value of two hours is presented when two hours of the dosing period remains, etc.).

Additionally, a timer which counts down rather than counting up may provide the ability to provide different timers with different containers by selecting an appropriate timer from a plurality of timers having different preset values. For instance, in the instance where a cover comprises the timer, one of a plurality of different covers may be selected (e.g., by a pharmacist) based on a corresponding dosing period of a pharmaceutical product. That is, one group of covers could include a timer having one a common first dosing period, another group of covers could include a timer have a common, but different, second dosing period, and so forth.

A first aspect of the present invention may be characterized as a pharmaceutical product supply. The pharmaceutical product supply includes a cover detachably engageable with a container, pharmaceutical product disposed in the container, and a sensor responsive to engagement of the cover with the container, The pharmaceutical product supply also includes a timer operatively interconnected with the sensor, along with an indicator operatively communicating with the timer for indicating a timer value. The timer is set to an initial timer value corresponding to a predetermined dosage period upon engagement of the cover with the container.

A number of feature refinements and additional features are applicable to the first aspect of the present invention. These feature refinements and additional features may be used individually or in any combination. As such, each of the following features that will be discussed may be, but are not required to be, used with any other feature or combination of features of the first aspect. The following discussion is applicable to the first aspect, up to the start of the discussion of a second aspect of the present invention.

Any appropriate type of sensor or combination of sensors may be utilized to determine when the cover has been engaged with the container (e.g., when the cover has been moved to a closed position to enclose pharmaceutical product within the container). A signal of any appropriate type may be sent to the timer in any appropriate manner at such a time. A sensor as used herein means any device or combination of devices that is responsive to a movement of the cover to or toward a closed position, and where the timer is activated responsive to such a movement of the cover to or toward such a closed position.

In one embodiment, a mechanical system determines when the cover has been moved to a closed position and relative to the container. Such a mechanical system may be a "sensor" in accordance with this first aspect. In one embodiment, there is a mechanical sensor for detecting engagement of the cover and the container. For example, the mechanical sensor may include disengagement of a pawl from a ratchet, movement of a spring, movement of a latch, or some other appropriate mechanism for mechanically detecting engagement of the cover and container. In one embodiment, there is a mechanical sensor in the form of a cam/follower arrangement, where a relative movement between the cam and follower (e.g, provided by movement of the cover to its closed position) "trips" the timer in any appropriate manner (e.g., mechanically releases the timer).

One or more sensors may transmit a non-mechanical signal of any appropriate type to the timer upon detecting engagement of the cover and the container or a disposal of the cover in its closed position. For example, the sensor may include an electrical sensor, an optical sensor, a resistive sensor, a capacitive sensor, or any other appropriate device for detecting engagement of the cover and the container.

The cover may include one or more sensors of the above-noted type. For instance, the sensor may be provided with the cover as an integrated unit. The cover may include the timer. For instance, the timer may be provided with the cover as an integrated unit, The timer may be mechanical. Alternatively, the timer may be electrical. In one embodiment, the timer counts down from the predetermined dosage period upon the engagement of the cover with the container.

The cover may include the indicator. In one embodiment, each of the sensor(s), timer, and indicator are incorporated by the cover so as to be in the form of an integrated unit. In any case, the indicator may be mechanical. Alternatively, the indicator may be electrical. Further still, the indicator may be selected from the group consisting of a dial indicator, an LCD, an LED display, an auditory indicator, another appropriate indicator, or a combination thereof. In an embodiment, the cover may have a viewing window through which the indicator is viewable from an exterior of the pharmaceutical product supply. Alternatively or additionally, the indicator may include a multicolor display. A plurality of colors of the multicolor display may correspond to different respective remaining times in the dosage period. Accordingly, the multicolor display may be operative to display a color indicative of a remaining period in a dosage period. The color may change such that a cursory viewing of the displayed color provides an indication of the remaining duration of the dosage period. The indicator may include quantitative indicia regarding the timer value. Accordingly, a number representative of the number of days, hours, minutes, seconds, some other appropriate duration, or a combination thereof, may be displayed. The indicator may also include an instruction to administer the pharmaceutical product, The instruction may be in the form of an audio instruction, such as a chime, tone, beep, or the like. Additionally, a recorded voice instruction may be used. Further still, the instruction may include a display with instructions or a command, such as "TAKE PHARMACEUTICAL PRODUCT NOW." As such, the instruction to administer the pharmaceutical product may be indicated at the conclusion of the timer. Such an instruction may convey the desired information in any appropriate manner.

The "predetermined dosage period" may be any appropriate period of time between which doses should be taken. For instance, a prescription may specify that a certain pharmaceutical product should be taken every 4 hours. In this case, the predetermined dosage period would be 4 hours. The predetermined dosage period may be designated in any appropriate manner (e.g., by an attending medical physician).

The timer value may be a remaining portion of the predetermined dosage period. Accordingly, the timer may be set to the initial timer value corresponding to the predetermined dosage period, and may count down the period such that expiration of the timer coincides with the conclusion of the dosage period. The predetermined dosage period may correspond to the pharmaceutical product (e.g., the predetermined dosage period may correspond to a prescription describing the appropriate use of the pharmaceutical product).

One embodiment includes a pharmaceutical product supply system including the pharmaceutical product supply of the first aspect. The pharmaceutical product supply system may also include a plurality of selectable covers that are detachably engageable with the container. A first group of the plurality of selectable covers may be associated with a first predetermined dosage period, and a second group of the plurality of covers may be associated with a second predetermined dosage period that is different from the first predetermined dosage period. The cover may be selected from the plurality of selectable covers. As such, multiple covers with multiple predetermined dosage periods may be provided such that an appropriate cover is selected from the plurality based on a pharmaceutical product, a prescription, or the like. The first group of the plurality of selectable covers may bear corresponding first indicia indicative of the first predetermined dosage period. Similarly, the second group of the plurality of selectable covers may bear corresponding second indicia indicative of the second predetermined dosage period. The first indicia and the second indicia may be visible (e.g., at all times) on an exterior of the pharmaceutical product supply system. In addition to covers provided with predetermined dosage periods, an embodiment may include a cover that has a programmable cover such that any dosage period may be selected. Additionally, the first and second indicia may comprise the initial timer value for the first group and second group, respectively.

A second aspect of the present invention is directed to a method of tracking pharmaceutical product dosage periods. The method involves coupling a cover to a container to contain a pharmaceutical product, sensing the coupling of the container and the cover in response to the coupling step, setting a timer to an initial timer value corresponding to a predetermined dosage period in response to the sensing step, commencing a timer, and indicating a timer value corresponding to a remaining time interval of the predetermined dosage period.

A number of feature refinements and additional features are applicable to the second aspect of the present invention. These feature refinements and additional features may be used individually or in any combination. As such, each of the following features that will be discussed may be, but are not required to be, used with any other feature or combination of features of the second aspect. The following discussion is applicable to the second aspect, up to the start of the discussion of a third aspect of the present invention.

The coupling of the container and cover may be sensed in any appropriate manner. For instance, the timer may be responsive to a relative movement between the container and cover in a direction that disposes the cover in a closed position (e.g., to enclose pharmaceutical product). This relative mechanical motion may be transmitted to the timer in any appropriate manner. For instance, there may a resulting mechanical movement or combination of mechanical movements that initiates the timer. A non-mechanical signal of any appropriate type (e.g., electrical, optical) may be transmitted to the timer in any appropriate manner, and the receipt of such a non-mechanical signal may initiate the timer.

In an embodiment, the commencing step may include counting down from the initial timer value after the setting step. As such, the timer may run, such that upon expiration of the timer, the dosage period may expire and coincide with an appropriate time for a subsequent administration of pharmaceutical product.

In another embodiment, the indicating step may include providing a visual indication. Alternatively or additionally, the indicating step may involve providing an auditory indication. Furthermore, the indicating step may involve changing a visible color corresponding to the timer value.

In another embodiment, the method of the second aspect may involve the step of instructing to administer the pharmaceutical product at the expiration of the dosing period. The predetermined dosage period may correspond to the pharmaceutical product (e.g., each pharmaceutical product type may have its own corresponding predetermined dosage period).

In yet another embodiment, the method may involve selecting the cover from a plurality of selectable covers. The selecting step may be at least partially based on a predetermined dosage period associated with the cover. The plurality of covers may include a plurality of groups of covers. Each group of the plurality of groups of covers may be associated with a predetermined dosage period that is different than other groups of the plurality of groups of covers.

In another embodiment, the method of the second aspect may involve the steps of decoupling the cover from the container and removing the pharmaceutical product from the container. Accordingly, once the pharmaceutical product is removed and the cover is coupled to the container in the coupling step, the initial timer value may be set and the timer may begin to track the dosage period. Thus, administration of the pharmaceutical product may coincide with the setting of the timer such that the pharmaceutical product supply facilitates assistance in determining the correct time for dosing.

A third aspect of the present invention may be characterized as a pharmaceutical product supply. The pharmaceutical product supply includes a cover detachably engageable with a container, pharmaceutical product disposed in the container, a timer, and an indicator that is operatively interconnected with the timer in any appropriate manner and that provides a timer value in any appropriate manner. The timer has an associated initial timer value corresponding to a predetermined dosage period. Operation of the timer is initiated in response to a movement of the cover into a closed position and relative to the container.

A number of feature refinements and additional features are applicable to the third aspect of the present invention. These feature refinements and additional features may be used individually or in any combination. As such, each of the following features that will be discussed may be, but are not required to be, used with any other feature or combination of features of the third aspect. The initial timer value of the timer may be reset responsive to a movement of the cover into a closed position and relative to the container, Moreover, the various features discussed above in relation to the first aspect may be utilized by this third aspect.

A fourth aspect of the present invention is directed to a method of tracking pharmaceutical product dosage periods. The method involves disposing a cover in a closed position in relation to a container, and which encloses a pharmaceutical product. A timer has a predetermined dosage period. Operation of this timer is commenced in response to the disposition of the cover into its closed position. A timer value (corresponding to a remaining time interval of the predetermined dosage period) may be conveyed in any appropriate manner, including during operation of the timer (e,g., prior to the expiration of the timer).

A number of feature refinements and additional features are applicable to the fourth aspect of the present invention, These feature refinements and additional features may be used individually or in any combination. As such, each of the following features that will be discussed may be, but are not required to be, used with any other feature or combination of features of the fourth aspect. Initially, the various features discussed above in relation to the second aspect may be utilized by this fourth aspect.

Disposing the cover into its closed position may be due to a detachable interconnection of any appropriate type between the cover and container (e.g., where the cover is totally removable from the container, for instance using a threaded interaction, a snap-lock, press-fit, or the like; where the cover is movably connected with the container, such as by a pivotal connection or the like). When the cover is in a closed position, the cover may be interlocked with the container in any appropriate manner, for instance via a threaded interaction, a snap-lock, press-fit, or the like.

The commencement of operation of the timer is subject to a number of characterizations. One is that at least some of the motion from the disposition of the cover into its closed position is transferred to the timer (e.g., a mechanical signal; having the motion of the cover relative to the container induce motion in one or more other components that in turn interact (e.g., mechanically) with the timer). Any appropriate non-mechanical signal could be sent to the timer to commence its operation (e.g., an electrical signal from one or more sensors; an optical signal from one or more sensors).

The predetermined dosage period of the timer may be reset responsive to the noted disposition of the cover into its closed position. Consider the case where the timer is operating, and where the indicator conveys the remaining portion of the predetermined dosage period. Moving the cover to an open position may suspend operation of the timer (e.g., if it has not counted down to "0"). The cover may of course be moved to its open position upon the indicator conveying that the predetermined dosage period has expired. In any case and when the cover is thereafter once again moved to its closed position, this may automatically reset to the predetermined dosage period of the timer.

A number of feature refinements and additional features are separately applicable to each of above-noted first, second, third, and fourth aspects of the present invention. These feature refinements and additional features may be used individually or in any combination in relation to each of the above-noted first, second, third, and fourth aspects of the present invention. Initially, each feature discussed in relation to any aspect may be utilized by each other aspect unless otherwise noted herein.

A "pharmaceutical product" as used herein may generally define any material or substance used in the course of a medical treatment, medical diagnosis, therapy, or the provision of any other appropriate medical care. A given material need not contain an active drug compound or ingredient to be considered a "pharmaceutical product" for purposes of the present invention.

A pharmaceutical product within a container for purposes of the present invention may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, powders, fluids (e.g., liquids, suspensions, emulsions), patches (e.g., transdermal patches), films (e.g., transmucosal or buccal), strips (e.g., transmucosal or buccal), or the like. Further, a "pharmaceutical product" may refer to or include any "drug" as defined in Title 21 of the United States Code, Section 321(g)(1).

All pharmaceutical product within a container for purposes of the present invention may be of at least substantially common dose. Alternatively, some pharmaceutical product could be of one dose (e.g., a prescribed dose), while some pharmaceutical product could be of a different dose (e.g., in the form of a transdermal patch that has been used by a patient, such that at least part of its original dosage has already been transdermally administered to the patient). All pharmaceutical product within a container could be in a common first condition, For instance and in the case of transdermal patches, all transdermal patches within the container could be contained within individual primary packaging (e.g., within a sealed pouch, jacket, foil wrapping, or the like), or all transdermal patches within the container could be in an exposed state (e.g., where the individual transdermal patches have been removed from their associated primary packaging before being disposed within a container). Some pharmaceutical product within a container could be in a common first condition, such as contained within individual primary packaging (e.g., within a sealed pouch, jacket, foil wrapping, or the like), while some pharmaceutical product within a container could be in a common second condition (e.g., in an exposed state or where the individual transdermal patches have been removed from their associated primary packaging before being disposed within a container (e.g., secondary packaging)).

Any transdermal patches utilized with the present invention may include any appropriate pharmaceutical product. Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocaine, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin 312; vasodilators such as nitroglycerin; vaccines; antiemetics; capsaicin; and nicotine.

Further, any transdermal patches utilized with the present invention can function to provide drug delivery in any appropriate manner. For instance, such transdermal patches may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)).

The container may be of any appropriate size, shape, configuration, and/or type. For instance, the container may be a standard pill bottle. In alternative embodiments, the container may be a vial, cartridge, blister package, or other pharmaceutical product storing apparatus. The interior may be appropriately sized to contain, hold, and/or store one or more pharmaceutical products. The interior may be accessed by way of the opening of the container. In this regard, the cover may be moved relative to a remainder of the container to gain access to the interior (e.g., by exposing the opening). Additionally, the cover may block the opening, substantially isolating the pharmaceutical product within the interior. In other words, the cover may be used for selectively allowing or providing access to the interior (e.g., to add and/or remove a pharmaceutical product).

When the cover is in a closed position, the cover may be interlocked with the container in any appropriate manner. Having the cover and container be interlocked provides at least some resistance to moving the cover to an open position. For instance, having the cover be interlocked with the container should keep the cover from moving to an open position by merely positioning the container in an "upside down" orientation.

Any of the embodiments, arrangements, or the like discussed herein may be used (either alone or in combination with other embodiments, arrangement, or the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a cover includes "a sensor" alone does not mean that the container includes only a single sensor). Moreover, any failure to use phrases such as "at least one" also does not limit the corresponding feature to the singular (e.g., indicating that a cover includes "a sensor" alone does not mean that the cover includes only a single sensor). Use of the phrase "at least generally," "at least partially," or the like in relation to a particular feature encompasses the corresponding characteristic and insubstantial variations thereof. Finally, a reference of a feature in conjunction with the phrase "in one embodiment" does not limit the use of the feature to a single embodiment.

DETAILED DESCRIPTION

Various embodiments of pharmaceutical product containers will be described in relation to the accompanying figures. A pharmaceutical product container with pharmaceutical product therein may be referred to as a "pharmaceutical product supply." In any case, these pharmaceutical product containers are configured to store "pharmaceutical product" as described herein (e.g., in any appropriate form, in any appropriate dose, and of any appropriate type), and furthermore include one or more features to facilitate the timing of a dosage period associated with the pharmaceutical product, including providing an indication as to the current temporal position within the dosage period. For instance, each of the following embodiments includes a timer and an indicator that together provide an indication of the remaining period in a predetermined dosage time period. By way of initial summary, the timer may be set to a predetermined dosage period associated with a pharmaceutical product upon engagement of a cover to a container storing the pharmaceutical product. The timer may track the remaining period of a predetermined dosage time period corresponding to the next appropriate administration of the pharmaceutical product and provide an indication as to the value corresponding to the remaining time prior to the next appropriate administration of pharmaceutical product.

Figure 1:
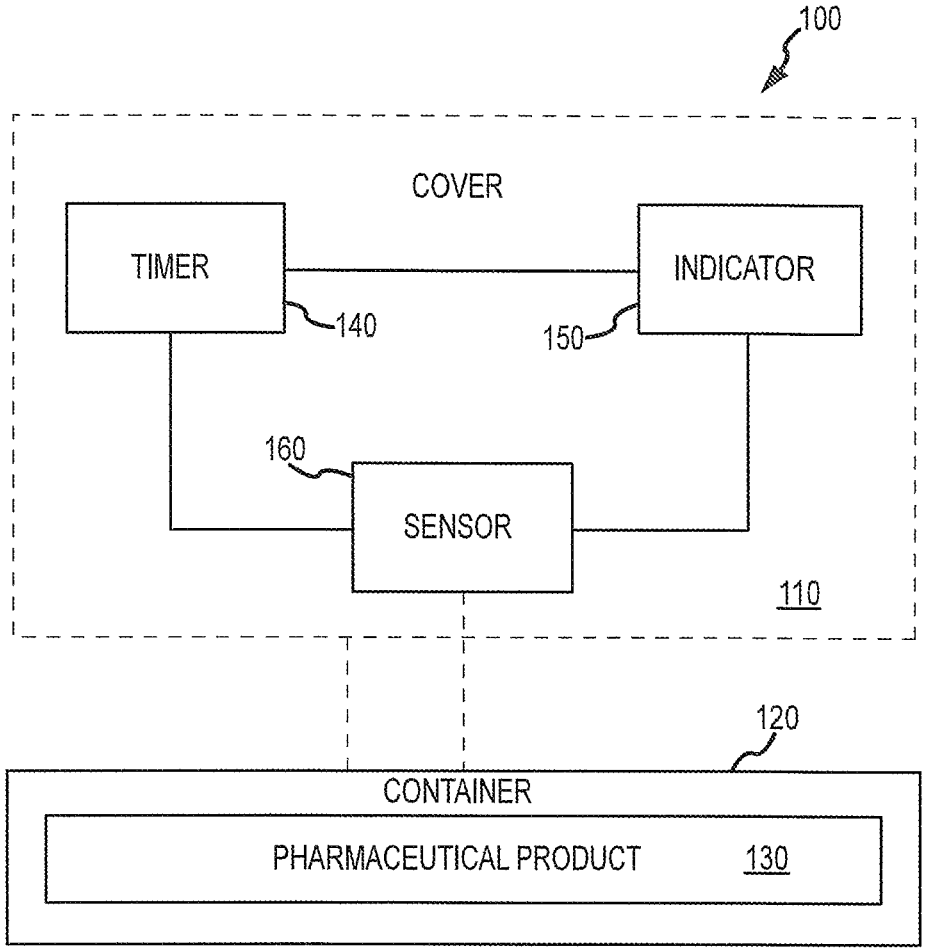
FIG. 1 is a schematic of an embodiment of a pharmaceutical product supply.
Figure 2:
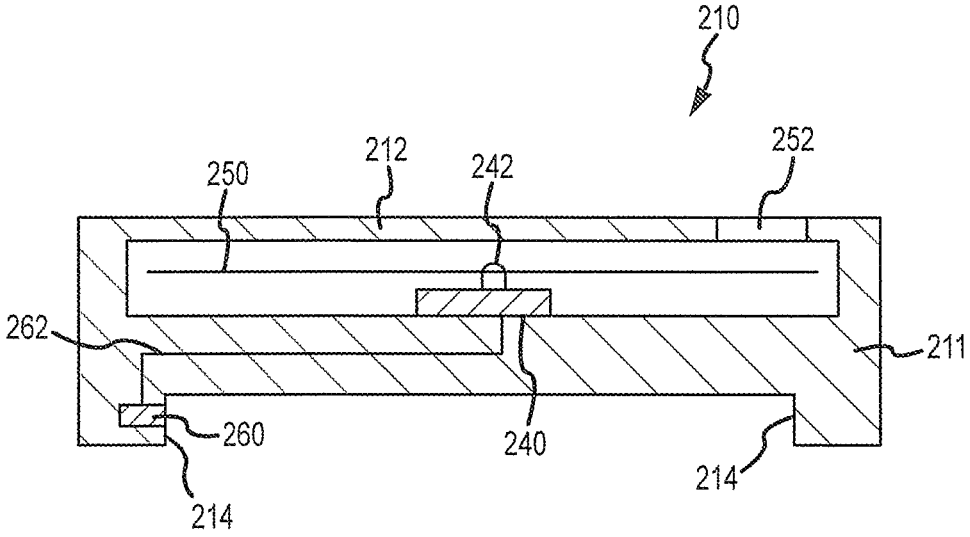
FIG. 2 is a cross-sectional view of an embodiment of a cover for a pharmaceutical product supply.

FIG. 1 shows one embodiment of a pharmaceutical product supply 100 in accordance with the foregoing, The pharmaceutical product supply 100 generally may be comprised of a cover 110 and a container 120 for storing a pharmaceutical product 130. The pharmaceutical product 130 may be contained with the container 120. Furthermore, the cover 110 may be detachably engageable with the container 120. In one embodiment, only pharmaceutical product 130 exists within the container 120.

The container 120 may be of any appropriate size, shape, configuration and/or type and, for instance, may be a common type of container structure for storing a pharmaceutical product. For example, the container 120 may comprise a standard pill bottle or standard vial for storing a pharmaceutical product. Similarly, the cover 110 may incorporate common features of a lid for a pharmaceutical product container, This may include a cover 110 comprising standard dimensions and standard safety features, such as a childproof design or the like.

The cover 110 may include a connector that is engageable with the container 120 (e.g., an end of the container 110 having an opening). In this regard, the cover 110 may be selectively detachably engaged with the container 120 at or in proximity to the opening (e.g., to block the same). "Detachably engaged" means that the cover 110 is at least partially removable from the container 120 without damaging the cover 110, the container 120, or any "joint" therebetween, such that the cover 110 may be reattached to the container 120. The cover 110 may be detachably engaged with the container 120 by being completely removable therefrom. Other configuration may also allow the cover 110 to be moved relative to the container 120 between open and closed positions, and yet still retain a physical interconnection in each such instance (e.g., where a cover is pivotally interconnected with a container not shown). Generally, the cover 110 should be movable relative to the container 120 between at least open and closed positions, where in the open position the interior of the container 120 is accessible (e.g., through an opening), and where in the closed position the interior of the container 120 is "closed off" by the cover 110 (e.g., where the opening is blocked by the cover 110). In one embodiment, the cover 110 is interlocked with the container 120 when the cover 110 is in a closed position. Any appropriate type of interlock may be utilized, for instance a threaded interface between the cover 110 and container 120, a snap-lock interface between the cover 110 and container 120, a press-fit interface between the cover 110 and container 120, or the like, When the cover 110 is engaged with the container 120, a pharmaceutical product 130 may be contained by the supply 100 within an interior (e.g., the pharmaceutical product 130 may be in an enclosed state or condition). The interior may be defined at least by the cover 110 and container 120 in an assembled state. In this regard, pharmaceutical product 130 located in the interior may be substantially isolated from an environment exterior to the container 120 and cover 110. The cover 110 may be detachably engaged with the container 120 such that the cover 110 may be repetitively engaged and disengaged without damaging either the cover 110 or the container 120 (e.g., so that pharmaceutical product 130 may be accessed and removed from the interior). A connector of the cover 110 and the container 120 may be in the form of a threaded connection, a snap-fit connection, an interference connection, a press-fit connection, or any other type of appropriate detachably engageable connection known in the art.

The cover 110 may further include a timer 140. The timer 140 may include a time period associated with a dosage period for the pharmaceutical product 130. A dosage period may correspond to a time period between doses or use of the pharmaceutical product 130. For instance, for a twice daily dose, a dosage period may be twelve hours. Any dosage period may be provided based on the pharmaceutical product 130 and/or physician's prescription. Examples of dosage periods include, but are not limited to a four hour dosage period (corresponding to a six time a day dose), a six hour dosage period (corresponding to a four time a day dose), an eight hour dosage period (corresponding to a three time a day dose), and a twenty-four hour dosage period (corresponding to a once daily dose).

The cover 110 may also include an indicator 150 in operative communication with the timer 140. The indicator 150 may provide an indication as to the remaining duration of the current dosage period. For instance, in the instant the dosage period commences and the timer 140 begins, the indicator 150 may indicate the full duration of the dosage period is remaining. This may be an initial timer value corresponding to the dosing period. As an example, for a 12 hour dosage period, the indicator 150 may denote that 12 hours remain at the commencement of the timer 140. As the timer 140 continues to count, the indicator 150 may change to reflect the reduced time until the end of the current dosage period is encountered. In this regard, the duration until the end of the current dosage time period may be reflected by the indicator 150 in any appropriate manner.

The cover 110 may further include a sensor 160 that is operable to detect the engagement of the cover 110 with the container 120, a movement of the cover 110 to or toward a closed position, or both. The sensor 160 may be a mechanical or electrical sensor. A mechanical sensor may be one that responds to motion of the cover 110 relative to the 120 as the cover 110 moves to a closed position, where this response (e.g., a mechanical signal) is in the form of moving one or more components and providing at least some type of mechanical interaction with the timer 140 (e.g., to initiate operation of the same). At least part of the motion of the cover 110 in moving to its closed position may be transferred to one or more components that interact with the timer 140 (e.g., to initiate operation of the timer 140, to reset the timer 140 to the initial timer value corresponding to the predetermined dosage period, or both).

Examples of mechanical sensors include disengagement of a pawl from a ratchet, movement of a spring, or movement of a latch, or some other appropriate device that is responsive to engagement of the cover 110 to the container 120 (e.g., a cam/follower arrangement; using a camming action to initiate operation of the timer 140). Electrical sensors may include optical sensors, resistive sensors, capacitive sensors, or some other appropriate device for detecting engagement of the cover 110 and container 120. In any case, the sensor 160 may be operative to generate a signal when the cover 110 is engaged with the container 120. This signal may include a mechanical or electrical signal. A mechanical signal may include movement of a linkage, release of a spring, winding of a spring, movement of a ratchet, or some other mechanical means of transmitting a signal. An electrical signal may include a voltage, change in voltage, a change in resistance, or some other means of electrical signal generation.

The sensor 160 may be in communication with the timer 140 and/or the indicator 150. Accordingly, upon detection of engagement of the cover 110 and container 120 by the sensor 160, the sensor 160 may communicate with the timer 140 and/or indicator 150 such that the timer 140 and indicator 150 are reset to the initial timer value. This may coincide with the engagement of the container 110 and cover 120 after a dosage of pharmaceutical product 130 has been removed from the container 120. As such, upon engagement of the container 120 and cover 110, the timer 140 may be set to the initial timer value corresponding to the dosage period such that a patient or other user may track the duration until the next dose may be appropriately administered.

In one embodiment, the pharmaceutical product supply 100 may use a mechanical system to reset the timer 140 and/or to trigger operation of the timer 140. For instance, upon the cover 110 coming into contact with the container 120, a spring may be loaded as the cover 110 is engaged with the container 120 (e.g., as the cover 110 and container 120 are threaded together, a spring may be wound). Once fully engaged, a mechanical sensor may detect engagement and begin the timer 140 that operates by a release of the energy from the wound spring. The wound spring may also drive the indicator 150 to display the appropriate remaining period in the dosage period.

Alternatively, an electronic sensor may be used in communication with an electronic timer. The system may also have an electrical indicator. Accordingly, a purely electronic system may be provided. Further still, the system may include portions of the mechanical and electrical systems described above such that a system having electrical and mechanical components is employed.

A mechanical system may also be used to determine when the cover 110 has been moved to a closed position and relative to the container 120, and this may be utilized to reset the timer 140 and/or to trigger operation of the timer 140. For instance, a cam/follower arrangement of any appropriate type may be utilized. Movement of the cover 110 relative to the container 120 (e.g., toward its closed position) may be utilized to reset the timer 140 and/or to trigger operation of the timer 140. For instance, at least some of the motion from the disposition of the cover 110 into its closed position may be transferred to the timer 140 (e.g., a mechanical signal; having the motion of the cover 110 relative to the container 120 induce motion in one or more other components that in turn interact (e.g, mechanically) with the timer 140).

It will be further appreciated that for different pharmaceutical products and different circumstances, different dosage periods may be provided. Accordingly, a plurality of covers 110 may be provided. These covers 110 may include groups of covers 110, characterized in that covers belonging to a group may have the same predetermined dosage period. Different groups may have different predetermined dosage periods. For example, there may be provided covers 110 having four hour dosage periods. These covers 110 may be characterized in that when engaged with a container 120, the timer 140 of one of these covers 110 is set to four hours and the indicator 150 reflects that four hours remain in the dosage period. As a further example, a second group of covers may be characterized in that when engaged with a container 120, the timer 140 of a cover of this second group of covers is set to eight hours and the indicator 150 reflects that eight hours remain in the dosage period. In this regard, any appropriate number of groups of covers 110 having different predetermined dosages periods may be provided. It is to be further understood that any number of groups having any appropriate predetermined dosage period may be provided. Accordingly, an appropriate cover 110 may be provided based on the pharmaceutical product 130 and/or a prescription associated with the pharmaceutical product 130.

Also, while the pharmaceutical product supply 100 depicted in FIG. 1 includes the timer 140, indicator 150, and sensor 160 provided as part of the cover 110, it will be understood that one or more of these components may be provided with or separately from the cover 110. In this regard, one embodiment of the pharmaceutical product supply 100 includes a cover 110 that is provided with a timer 140, an indicator 150, and a sensor 160. However, alternative embodiments may be provided where not all components are provided with the cover 110, but may be provided with the container 120, or separate from each of the container 120 or cover 110.

An embodiment of a cover 210 for a pharmaceutical product supply is shown in FIGS. 2, 3, and 4A-4C (e.g., the cover 210 may be used as the cover 110 for the case of the pharmaceutical product supply 100 shown in FIG. 1). The cover 210 may include all features and details as discussed with regard to the cover 110 shown and described with reference to FIG. 1. The cover 210 generally forms a cover body 211. The cover body 211 may include a connector 214 that may engage a portion of a container 320 (shown in FIG. 3). A sensor 260 may be provided adjacent to the connector 214 to sense engagement of the connector 214 to the container 320. The sensor 260 may have a communication link 262 to a timer 240. The timer 240 may be in communication with an indicator 250. The indicator 250 may be a dial indicator. The cover 210 may include a spindle 242 about which the dial indicator 250 may turn. The timer 240, or some other mechanism or device in communication with the timer 240, may move the spindle 242 to rotate the dial indicator 250 as the timer 240 progresses. The dial indicator 250 may be disposed adjacent to a covering layer 212 that overlays the dial indicator 250. The covering layer 212 may include a viewing window 252 through which a portion of the dial indicator 250 may be viewed.

Figure 3:
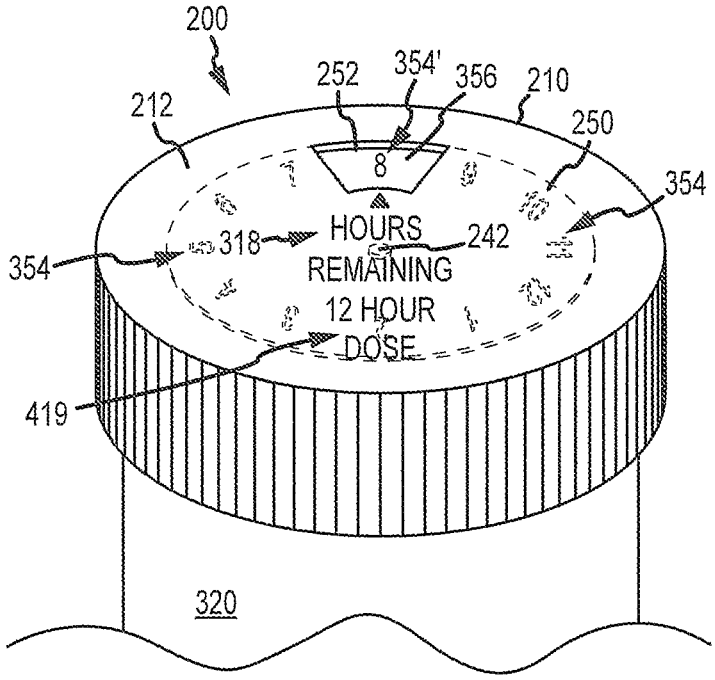
FIG. 3 is a perspective view of an embodiment of a pharmaceutical product supply that utilizes the cover of FIG. 2.

With additional reference to FIG. 3, a pharmaceutical product supply 200 including the cover 210 and a container 320 is shown. A viewable portion 356 of the dial indicator 250 may include a viewable value 354' that is provided on the dial indicator 250. The dial indicator 250 may include a plurality of values 354 that correspond to different values of the remaining time period in a dosage period. Thus, the viewable portion 356 of the dial indicator 250 may change as different portions of the dial indicator 250 bearing different values 354 pass by the viewing window 252. Accordingly, the viewable value 354' visible through the viewing window 252 may correspond to the current value for the remaining duration of the current dosage period. In this regard, a remaining duration indicator 318 may be provided on the exterior surface of the covering layer 212 to indicate that the viewable value 354° represents the duration remaining in the current dosage period. Additional indicia corresponding to the predetermined timer may be provided as timer value indicia 419. In this regard, the timer value indicia 419 may be used to identify the cover 210 from among a plurality of covers which may include different predetermined timer values. As such, the proper cover 210 may be selected from the plurality of covers for a pharmaceutical product having a specific dosage period using the timer value indicia 419.

Figure 4A:
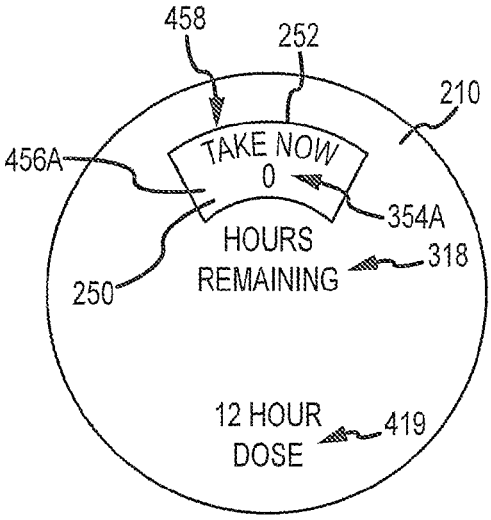
FIG. 4A-C are end views of the cover of FIG. 2 at different times.
Figure 4B:
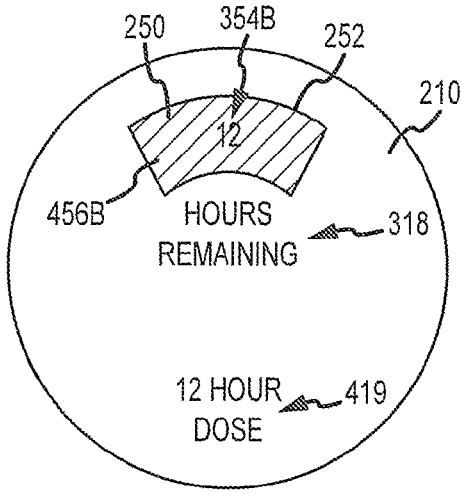
Figure 4C:
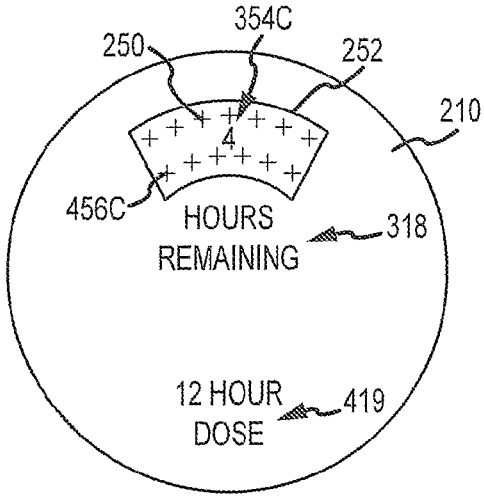
Figure 5:
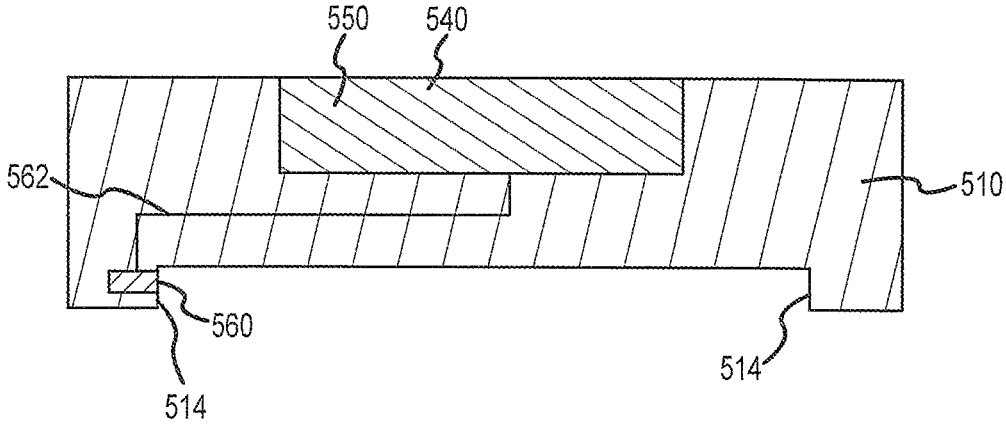
FIG. 5 is a cross-sectional view of another embodiment of a cover for a pharmaceutical product supply.

With further reference to FIGS. 4A-C, the cover 210 is shown at different instances. FIG. 4A shows the cover 210 when the timer 240 is expired (e.g., at the end of a dosage period). Accordingly, a first visible value 354A may be "0" indicating that no time is left in the current dosage period. Additionally, instructions 458 may be visible in the viewing window 252, instructing that the pharmaceutical product should now be administered, In this regard, the instance depicted in FIG. 4A may be the appropriate time to administer the pharmaceutical product. As such, the cover 210 may be removed from the container 320 (shown in FIG. 3) storing the pharmaceutical product, pharmaceutical product may be removed, the removed pharmaceutical product may be administered, and the cover 210 may be engaged with the container 320. This engagement of the cover 210 with the container 320 may result in the setting of the timer 240 to the predetermined dosage period (i.e., twelve hours for the embodiment shown in FIGS. 2, 3, and 4A-C as indicated by the timer value indicia 419). Upon the engagement of the cover 210 with the container 320, the cover 210 may appear as shown in FIG. 4B. A second visible value 354B may be "12," indicating that twelve hours (in this case, the full dosage period) remain in the dosage period, In addition to the second visible value 354B being provided upon setting of the timer 240 to the dosage period, a color 456B may be provided on the dial indicator 250 such that the color 456B is visible through the viewing window 252. The color 456B may correspond to the second visible value 354B representing the full duration of the dosage period remains, The timer 240 may continue to run and a corresponding rotation of the spindle 242, as well as dial indicator 250, may occur as time passes from the last instance of engagement of the cover 210 and container 320. As such, different values 354 may be continually displayed by the dial indicator 250 through the viewing window 252. For example, eight hours after the cover 210 and container 320 were engaged, the cover 210 may appear as shown in FIG. 4C. That is, a third visible value 3540 may show a "4" indicating four hours of dosage period remain until the conclusion of the current dosage period. In addition to the third visible value 3540 being shown, a color 456C may be displayed on the dial indicator 250 that corresponds with the third visible value 3540. The color 4560 may be different than the color 456B, such that upon viewing the color displayed, an individual may quickly determine the status of the timer 240 (e.g., without having to read the displayed value 354'), Upon continuation of the timer 242, the cover 210 may once again appear as shown in FIG. 4A at the conclusion of the dosage period. That is, the first visible value 354A and a color 456A may be displayed in the viewing window 252. The color 456A may be different than the colors 456B and 4560. In one example, color 456A may be green, color 456B may be yellow, and color 4560 may be red such that gradients of these colors may be provided on the dial indicator 250 between colors 456A, 456B and 4560. In this regard, a respective color 456A-456C viewable through the viewing window 252 may provide another indication as to the duration of the dosage period remaining. The cover 210 may be removed from the container 320 (FIG. 3), pharmaceutical product may be removed, the removed pharmaceutical product may be administered, and the cover 210 may be engaged with the container, thus initiating the process described above.

Another embodiment of a cover 510 for use in a pharmaceutical product supply system, such as the one shown and described with reference to FIG. 1, is shown in FIGS. 5 and 6A-C (i.e., the cover 510 may be used in place of the cover 110 in the pharmaceutical product supply 100 of FIG. 1). In this regard, the cover 510 may include a timer value indicia 619 to indicate the dosing period associated with the cover 510, as well as a remaining duration indicator 618 (e.g., to provide a displayed value of the time remaining in the predetermined dosage period). Additionally, the cover 510 may include a connector 514 that is operable to connect the cover 510 to a container (not shown in FIG. 5; e.g., container 320 of FIG. 3), The cover 510 may also have a sensor 560 to sense engagement of the connector 514 to the container (e.g., to detect a disposition of the cover 510 into the closed position; to detect an interlocking of the cover 510 with the container).

The cover 510 may include all features and details as discussed with regard to the cover 110 of the pharmaceutical product supply 100 shown and described with reference to FIG. 1. The cover 510 may include an indicator 550 that is different than the indicator 250 shown and discussed with respect to FIGS. 2, 3, and 4A-C. For instance, the cover 510 may include an indicator 550 that is integrated with a timer 540. Accordingly, the sensor 560 may provide a signal via a communications link 562 to the timer 540. The indicator 550 may comprise an auditory indicator that uses sounds, tones, or other appropriate audible alerts to indicate a remaining duration of a dosing period. For example, the indicator 550 may be a recorded voice instructing to administer the pharmaceutical product, such as, "It is now time to take your medicine." Additionally, the timer 540 may include an external display 654 that comprises the indicator 550. The external display 654 may be an LCD, LED display, an e-ink display, or any other appropriate visual indicator as shown in FIGS. 6A-6C.

Figure 6A:
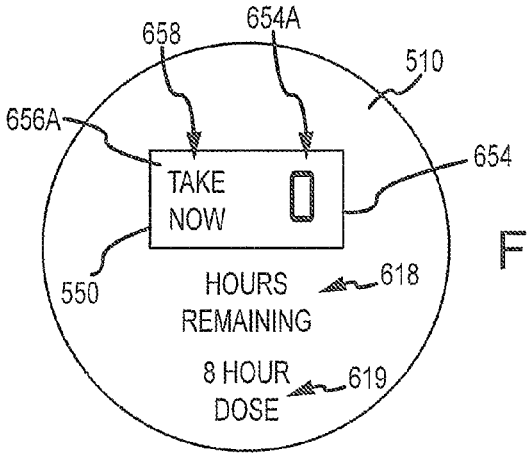
FIG. 6A-C are end views of the cover of FIG. 5 at different times.
Figure 6B:
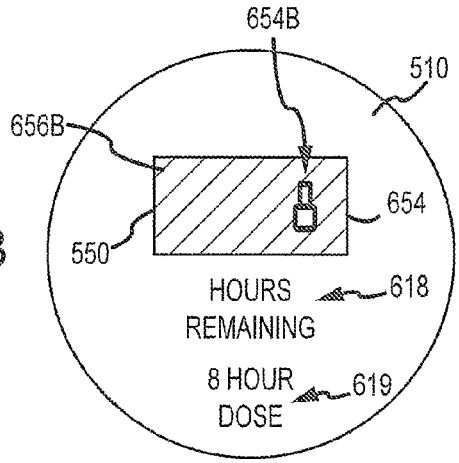
Figure 6C:
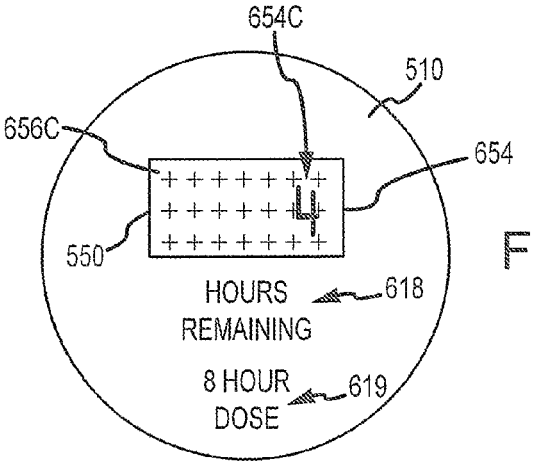

As shown in FIGS. 6A-C, the cover 510 may be similar to the cover 210 in that at the interval shown in FIG. 6A, the display output or value 654A (presented on the display 654) indicates that "0" hours remain in the current dosage period. Thus, the instance shown in FIG. 6A corresponds to the expiration of a dosing period. As such, instructions 658 may be presented on the display 654 to convey that the pharmaceutical product should be administered. In accord with the process described with reference to FIG. 4A, the pharmaceutical product may be administered and the cover 510 may be engaged with a container (not shown, but for instance, container 320 shown in FIG. 3). Upon engagement of the connector 514 to the container as sensed by the sensor 560, the dosage period may be set, as shown in FIG. 6B, to the display output or value 654B (i.e. in the form of an "8"). In conjunction with the remaining duration indicator 618, the display output or value 654B indicates that eight hours remain in the dosage period. As indicated by the timer value indicia 619, the cover 510 may include a predetermined dosage period of eight hours. The timer 540 may progress such that four hours after the timer 540 has been set, the cover 510 may appear as shown in FIG. 6C. As such, the display output or value 654C includes a "4," indicating four hours remain in the dosage period. Further, the process may continue until the expiration of the dosage period such that, again, the cover 510 is as shown in FIG. 6A. As in the case of the cover 210, different colors 656A, 656B, and 656C may be presented on the display 654 at respective times during the dosage period as an additional visual indicator of the remaining dosage period.

Figure 7:
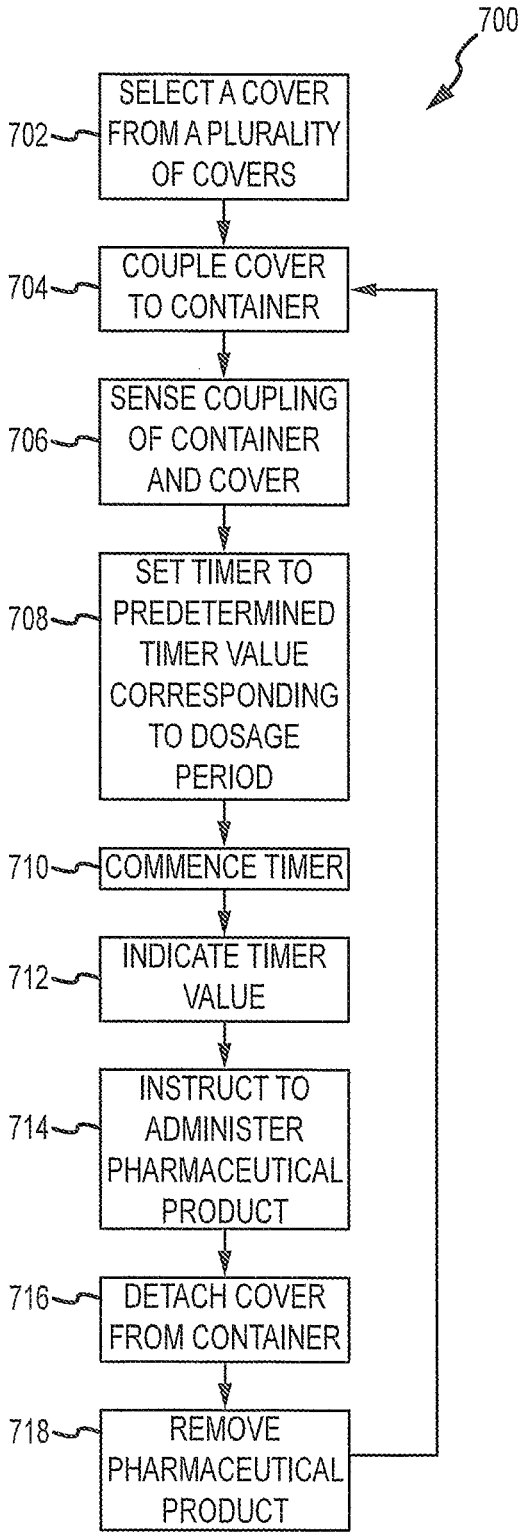
FIG. 7 is a flowchart of an embodiment of a method for timing dosage periods.

Turning to FIG. 7, a process 700 for timing a dosage period using a pharmaceutical product supply is shown. The process may begin by selecting (702) a cover from a plurality of covers. For instance, a number of groups covers may be provided, each group characterized as having a different predetermined dosage period value. As examples, groups of covers may be provided having four hour dosage periods, eight hour dosage periods, twelve hour dosage periods, or twenty-four hour dosage periods, to name a few possibilities. It will be understood any number of different covers having different dosage periods may be provided. Once selected (702), the cover may be coupled (704) to a container. The coupling (704) may be to contain a pharmaceutical product within the container as is common in the storage and transport of pharmaceutical products.

The process 700 may proceed such that upon the coupling (704) of the cover to the container, the engagement of the two is sensed (706) (e.g., by way of a mechanical or electrical sensor). Upon the sensing (706) of the coupling (704), the process 700 may proceed such that a timer is set (708) to the predetermined dosage period of the selected cover. Additionally, the process may include commencing (710) the timer such that the timer begins downwardly incrementing the remaining dosage period. As the timer runs after the commencing (710), the process may include indicating (712) the remaining time of the dosage period. The indicating (712) may be continually or near continually incremented such that the remaining time is reflected in days, hours, minutes, seconds, another appropriate duration, or a combination thereof. Alternatively, the indicating (712) may be updated periodically. For instance, the indicating (712) may include indicating the number of remaining hours, such that the indicating (712) is updated on an hourly basis.

In one embodiment, the process 700 may proceed to instructing (714) to administer the pharmaceutical product. The instructing (714) may involve displaying instructions or a command regarding the pharmaceutical product. Further, the instructing (714) may involve an audible instruction or command regarding the administration of the pharmaceutical product. It will be understood that the instructing step (714) may not be provided in some embodiments of the process 700.

After the expiration of the timer (and the instructing (714) if included in the process 700), the process may involve detaching (716) the cover from the container. This may facilitate removal (718) of pharmaceutical product from the container such that the pharmaceutical product may be administered. The process 700 may repeat such that after removal (718) of the pharmaceutical product, the cover is coupled (704) to the container such that the process 700 may include repeating all of or a portion of the process 700. It is to be understood that while the process 700 depicted in FIG. 7 is exemplary for an embodiment of a method, other steps or orders may be used. For instance, the instructing step (714) may be optional as described above.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such or other embodiments and with various modifications required by the particular application (s) or use(s) of the present invention. It is intended that the appended claims be construed to include alternative embodiments to the extent permitted by the prior art.

What is claimed is:

1. A pharmaceutical product supply, comprising:

a container;

a cover detachably engageable with said container;

pharmaceutical product disposed in said container;

a timer responsive to a movement of said cover into a closed position and relative to said container, wherein said timer comprises an initial timer value corresponding to a predetermined dosage period; and an indicator in operative communication with said timer for indicating a timer value, wherein said timer is initiated by disposing said cover in said closed position and relative to said container, wherein said timer counts down from said initial timer value upon said timer being initiated and said indicator provides an indication of a corresponding said timer value, wherein said timer value is viewable on an exterior of said cover, wherein said cover comprises each of said timer and said indicator, and wherein said cover further comprises dosage period indicia on said exterior of said cover, that remains visible during operation of said timer, and that conveys said predetermined dosage period.

2. The pharmaceutical product supply of claim 1, wherein said timer is set to said initial timer value by said movement of said cover into said closed position.

3. The pharmaceutical product supply of claim 1, further comprising:

a sensor responsive to disposing said cover in said closed position, wherein said timer is operatively interconnected with said sensor.

4. The pharmaceutical product supply of claim 3, wherein said cover comprises said sensor.

5. The pharmaceutical product supply of claim 1, wherein said cover comprises a viewing window through which said indicator is viewable from said exterior of said cover.

6. The pharmaceutical product supply of claim 1, wherein said indicator comprises a multicolor display, and wherein a plurality of colors of said multicolor display correspond to a plurality of timer values.

7. The pharmaceutical product supply of claim 1, wherein said indicator comprises a quantitative indicia corresponding to said timer value.

8. The pharmaceutical product supply of claim 1, wherein said indicator comprises an instruction to administer said pharmaceutical product.

9. The pharmaceutical product supply of claim 8, wherein said instruction to administer said pharmaceutical product is indicated at the conclusion of said timer.

10. The pharmaceutical product supply of claim 1, wherein said timer value comprises a remaining portion of said predetermined dosage period.

11. The pharmaceutical product supply of claim 1, wherein said predetermined dosage period corresponds to said pharmaceutical product.

12. A pharmaceutical product supply system, comprising:

a container;

a plurality of covers that are each detachably engageable with said container, wherein a first group of said plurality of covers is associated with a first predetermined dosage period and each cover in said first group comprises first dosage period indicia on an exterior of said cover that conveys said first predetermined dosage period, wherein a second group of said plurality of covers is associated with a second predetermined dosage period that is different from said first predetermined dosage period and each cover in said second group comprises second dosage period indicia on an exterior of said cover that conveys said second predetermined dosage period, and wherein one of said plurality of covers is selected and is detachably engaged with said container;

pharmaceutical product disposed in said container;

a timer responsive to a movement of said cover into a closed position and relative to said container, wherein said timer comprises an initial timer value corresponding to said predetermined dosage period for said cover; and an indicator in operative communication with said timer for indicating a timer value on said exterior of said cover, wherein said timer is initiated by disposing said cover in said closed position and relative to said container, and wherein said timer counts down from said initial timer value upon said timer being initiated and said indicator provides an indication of a corresponding said timer value on said exterior of said cover.

13. The pharmaceutical product supply system of claim 12, wherein said first dosage period indicia and said second dosage period indicia comprise said initial timer value for said first group and said second group, respectively.

14. The pharmaceutical product supply system of claim 12, wherein said cover comprises each of said timer and said indicator.

15. The pharmaceutical product supply of claim 12, wherein said timer is set to said initial timer value by said movement of said cover into said closed position.

16. The pharmaceutical product supply of claim 12, further comprising:

a sensor responsive to disposing said cover in said closed position, wherein said timer is operatively interconnected with said sensor.

17. The pharmaceutical product supply of claim 16, wherein said cover comprises said sensor.

18. The pharmaceutical product supply of claim 12, wherein said cover comprises a viewing window through which said indicator is viewable from said exterior of said cover.

19. The pharmaceutical product supply of claim 12, wherein said indicator comprises a multicolor display, and wherein a plurality of colors of said multicolor display correspond to a plurality of timer values.

20. The pharmaceutical product supply of claim 12, wherein said indicator comprises a quantitative indicia corresponding to said timer value.

21. The pharmaceutical product supply of claim 12, wherein said indicator comprises an instruction to administer said pharmaceutical product.

22. The pharmaceutical product supply of claim 21, wherein said instruction to administer said pharmaceutical product is indicated at the conclusion of said timer.

23. The pharmaceutical product supply of claim 12, wherein said timer value comprises a remaining portion of said predetermined dosage period.

24. The pharmaceutical product supply of claim 12, wherein said predetermined dosage period corresponds to said pharmaceutical product.

* * * * *